US007515864B2

(12) United States Patent
Imada et al.

(10) Patent No.: US 7,515,864 B2
(45) Date of Patent: Apr. 7, 2009

(54) IMAGE FORMING APPARATUS

(75) Inventors: Takanoshin Imada, Saitama (JP); Yuichi Fujisawa, Saitama (JP); Masashi Sudo, Saitama (JP); Junichi Yumoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 364 days.

(21) Appl. No.: 11/213,697

(22) Filed: Aug. 30, 2005

(65) Prior Publication Data

US 2006/0182476 A1 Aug. 17, 2006

(30) Foreign Application Priority Data

Feb. 15, 2005 (JP) ..... 2005-037598

(51) Int. Cl.
*G03G 15/00* (2006.01)

(52) U.S. Cl. ..... 399/377; 399/405

(58) Field of Classification Search ..... 400/693; 399/367, 405, 407; 347/108, 363
See application file for complete search history.

(56) References Cited

U.S. PATENT DOCUMENTS

2006/0056875 A1* 3/2006 Karasawa et al. ..... 399/107

FOREIGN PATENT DOCUMENTS

JP 05-219308 A 8/1993
JP 11-122406 A 4/1999
JP 2001-034141 A 2/2001
JP 2001-203840 A 7/2001
JP 2001-326770 A 11/2001
JP 2002323802 A * 11/2002
JP 2003-298792 A 10/2003
WO 03/069415 A1 8/2003

* cited by examiner

*Primary Examiner*—Daniel J Colilla
*Assistant Examiner*—Allister Primo
(74) *Attorney, Agent, or Firm*—Sughrue Mion, PLLC

(57) ABSTRACT

In an image forming apparatus including an image reading unit, an image forming unit, and a column support portion supports the image reading unit in a cantilever manner so that a space is provided between the image reading unit and an upper surface of the image forming unit, and receives the image reading unit at an upper surface and a side surface thereof. Further, the image reading unit may be provided with a downwardly extending portion extending downward from a lower surface thereof, and the column support portion may receive the lower surface of the image reading unit at the upper surface thereof, and receive the downwardly extending portion of the image reading unit at the side surface thereof.

17 Claims, 17 Drawing Sheets

IMAGE FORMING APPARATUS

CROSS-REFERENCE TO RELATED APPLICATION

This application claims priority under 35 USC 119 from Japanese Patent Application No. 2005-37598, the disclosure of which is incorporated by reference herein.

BACKGROUND OF THE INVENTION

1. Field of the Invention

The present invention relates to an image forming apparatus, and more particularly to an image forming apparatus having an image reading unit, an image forming unit and a column support portion supporting the image reading unit, and achieves more simple structure of the column support portion.

2. Description of the Related Art

There has been conventionally devised an image forming apparatus in which an image forming unit is mounted on an upper surface of a paper feeding unit, and an image reading unit is arranged above the image forming unit. Further, there is proposed a structure in which a support body supporting the image reading unit is fixed to a back surface of the paper feeding unit.

In accordance with the structure mentioned above, the image reading unit supported by the support body can move integrally along with a movement of the image forming unit and the paper feeding unit. Further, since the paper feeding unit is positioned in a lowest portion of the image forming apparatus, and receives papers in an inner portion thereof, the paper feeding unit is sufficiently heavier in comparison with the image reading unit. Accordingly, the image reading unit can be maintain a stable state by the support body. Further, since weights of the image forming unit and the paper feeding unit are not applied to the support body, it is sufficient that the support body is provided with a strength for supporting only the weight of the image reading unit. Accordingly, it is possible to make the structure of the support body simple. (For example, refer to Japanese Patent Application Laid-Open (JP-A) No. 2001-203840.)

However, as described in FIG. 8 of JP-A No. 2001-203840, a loading portion loading the image reading unit of the support body is constituted by a pair of loading members, and a joint member which is joining these pair of loading members, therefore a structure is complicated. Further, the cost to from this structure will be high.

SUMMARY OF THE INVENTION

The present invention is devised to solve the problem mentioned above, and provides an image forming apparatus in which a support portion supporting an image reading unit is formed in more simple structure.

A first aspect of the invention provides an image forming apparatus including an image reading unit; an image forming unit; and a column support portion supporting the image reading unit, wherein the column support portion supports the image reading unit in a cantilever manner so that a space is provided between the image reading unit and an upper surface of the image forming unit, and receives the image reading unit at an upper surface and a side surface thereof.

In the image forming apparatus in accordance with the first aspect, the image reading unit is received by the upper surface and the side surface of the column support portion. Accordingly, it is not necessary to independently provide a loading portion loading the image reading unit, and the structure of the column support portion can be simple.

Further, a structure is made such that a space is formed between the image forming unit and the image reading unit, except at the column support portion. In accordance with the structure mentioned above, it becomes easy to pick up a paper discharged at the space between the image forming unit, for example, and the image reading unit, and the structure can be excellent in design.

A second aspect of the invention provides an image forming apparatus including an image reading unit; an image forming unit; and a plurality of column support portions supporting the image reading unit, wherein the column support portions supports the image reading unit in a cantilever manner so that a space is provided between the image reading unit and an upper surface of the image forming unit, and receives the image reading unit at respective upper surfaces and side surfaces thereof.

As described above, in accordance with the invention, since the structure is made such that the load of the image reading unit is received by the upper surface and the side surface of the column support portion, it is possible to obtain an image forming apparatus having a simple structure of the column support portion.

BRIEF DESCRIPTION OF THE DRAWINGS

An embodiment of the present invention will be described in detail based on the following figures, wherein:

FIGS. 9A to 9C show the second column support, in which FIG. 9A shows a state before joining two metal sheets, FIG. 9B shows a state after joining two metal sheets, and FIG. 9C shows a cross sectional view along a line C-C in FIG. 9B;

FIGS. 12A to 12B show a state in which the image reading unit is attached to the first column support and the second column support, in which FIG. 12A is a view seen obliquely from a rear side, and FIG. 12B is an enlarged view of a square portion in FIG. 12A;

DETAILED DESCRIPTION OF THE INVENTION

Figure 1:
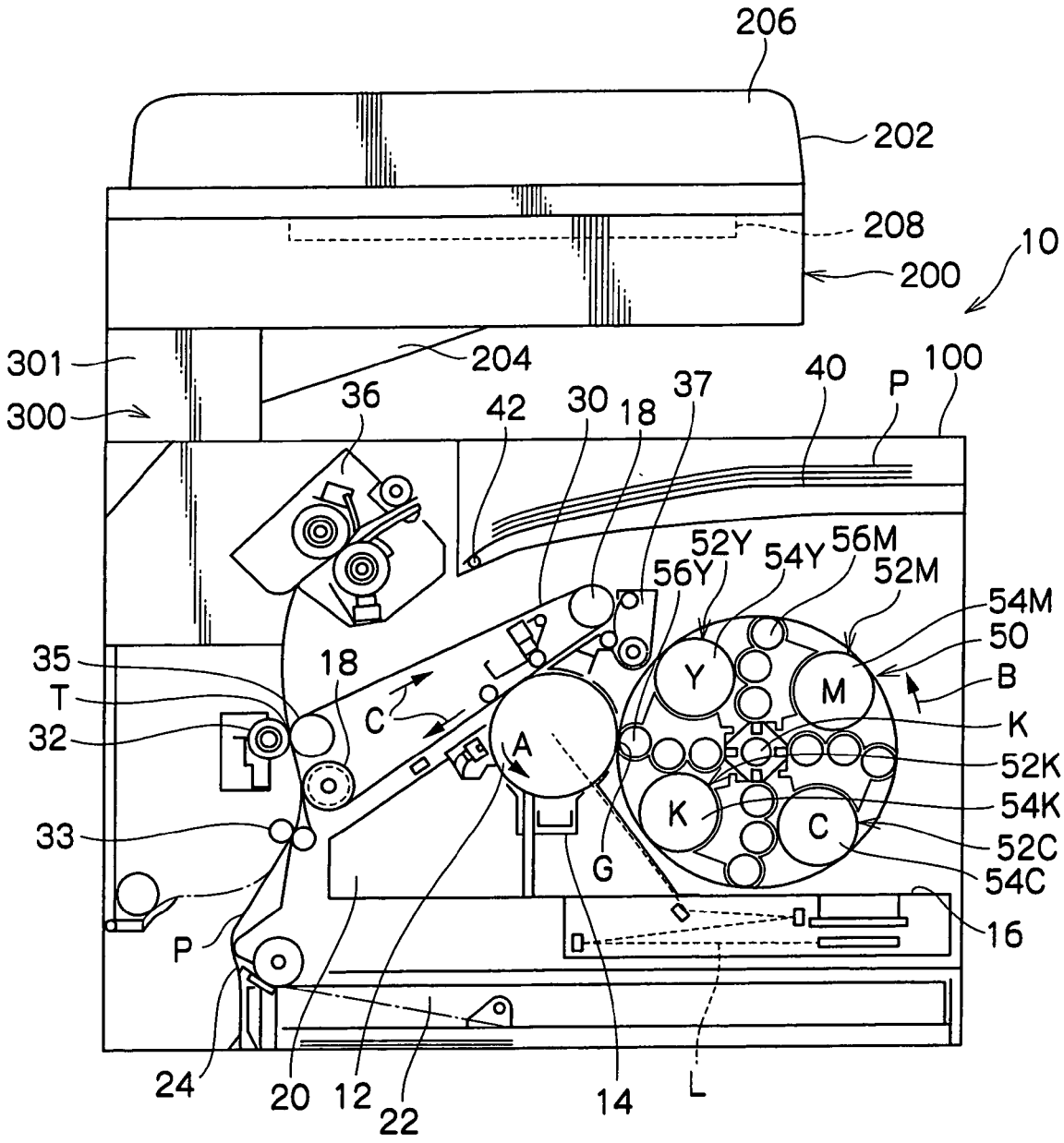
FIG. 1 is a schematic view showing a digital copying machine in accordance with an embodiment of the invention.
Figure 3:
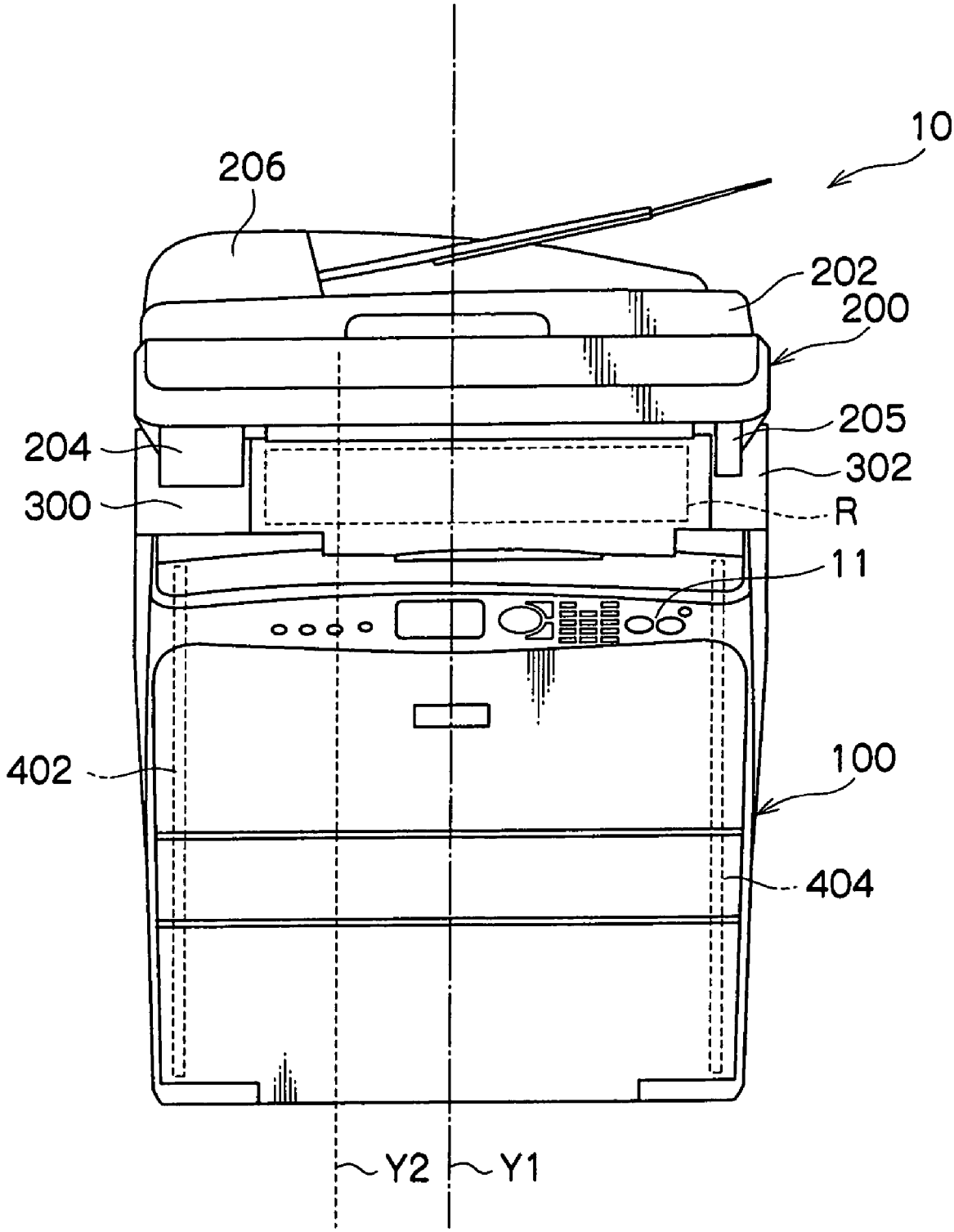
FIG. 3 is a front view of the digital copying machine.

As shown in FIGS. 1 and 3, a digital copying machine 10 as one example of an image forming apparatus according to an embodiment of the present invention is structured such that an image reading unit 200 is arranged in a cantilever manner with a space provided between a paper discharge tray 40 corresponding and an upper surface of an image forming unit 100. The image reading unit 200 reads an original and converts the original into digital image data. The image forming unit 100 forms a full color image on a recording paper P in accordance with a known electrophotographic process by using respective color toners of magenta (M), yellow (Y), cyan (C) and black (K), on the basis of the digital image data which is read by the image reading unit 200. Further, a side having an operation panel 11 by which a user executes various operations as shown in FIG. 3 corresponds to a front face side of the apparatus, and an opposite side corresponds to a back face side of the apparatus. A lateral (right-left) direction of the apparatus is defined on the basis of definition of the front face and the back face.

First, description will be given for the image reading unit 200.

Figure 2:
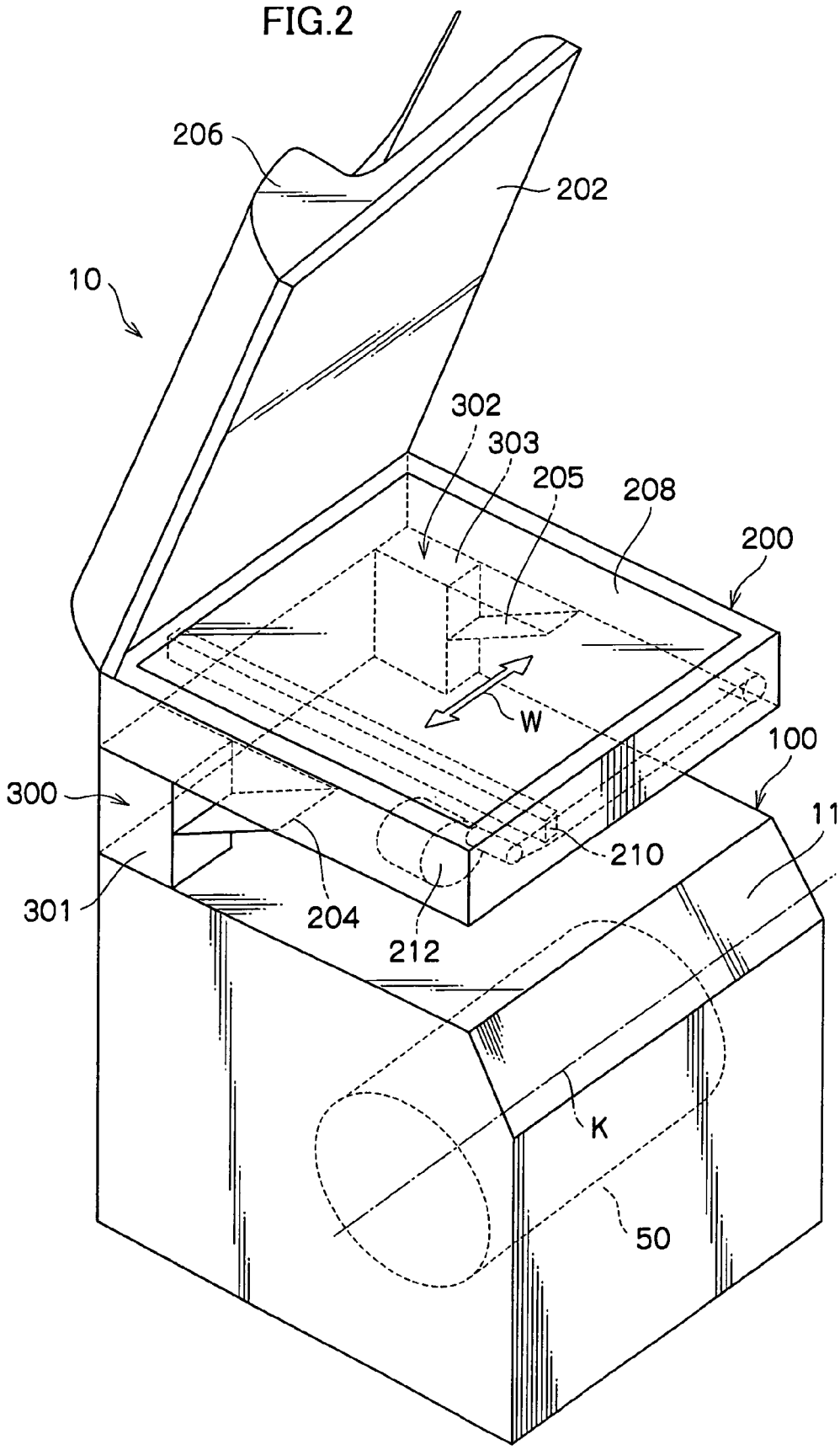
FIG. 2 is a perspective view schematically showing a state in which a presser foot plate of an image reading unit of the digital copying machine is open.

As shown in FIGS. 2 and 3, the image reading unit 200 is formed in a substantially square shape in a plan view, and is attached onto first column support portion 300 and second column support portion 302 provided in a rising manner in a back face side corner portion of the image forming unit 100, at two corner portions in the back face side of the image reading unit 200.

As shown in FIG. 2, a presser plate 202 provided at an upper portion of the image reading unit 200 can rotate to be opened. A transparent copy table 208 constituted by a platen glass or the like for placing the original on an upper surface thereof is provided below the presser plate 202. Further, an automatic original feeding unit 206 is provided at an upper portion of the pressure plate 202. A reading bar 210 constituted by CCD or the like, for reading the original placed on the copy table 208 is provided below the copy table 208. The reading bar 210 is elongated in a direction from the front face to a rear face of the apparatus. Further, the reading bar 210 performs a scanning in a direction of an arrow W, by a scan driving mechanism 212, and reads an image of the original placed on the copy table 208.

As shown in FIG. 2, downwardly extending portions 204 and 205 are formed in an inverted triangular shape, and are formed along a side end portion of the image reading unit 200 such that the side end portion forms a base edge of the triangle.

Figure 4:
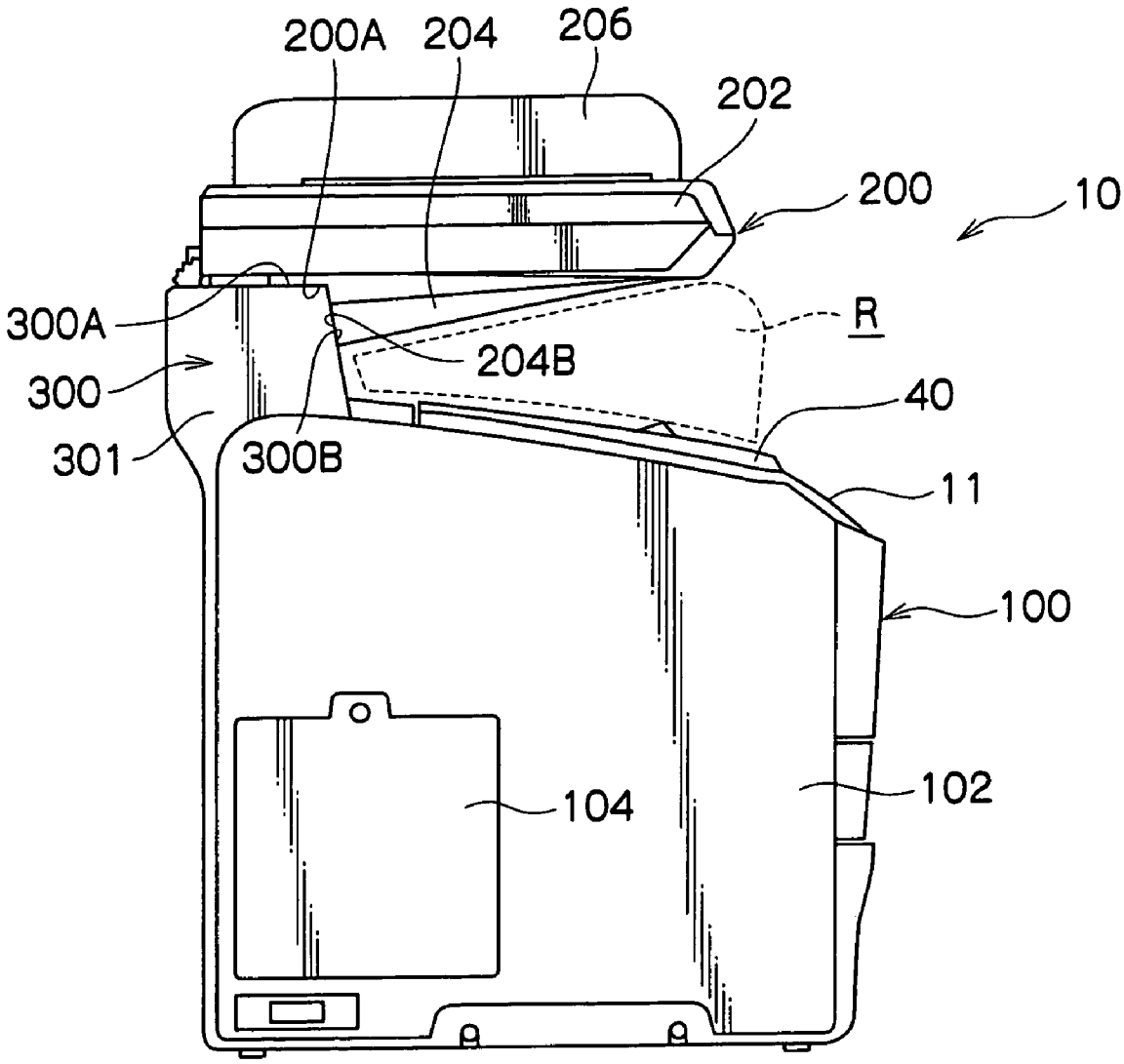
FIG. 4 is a side view of the digital copying machine.
Figure 5:
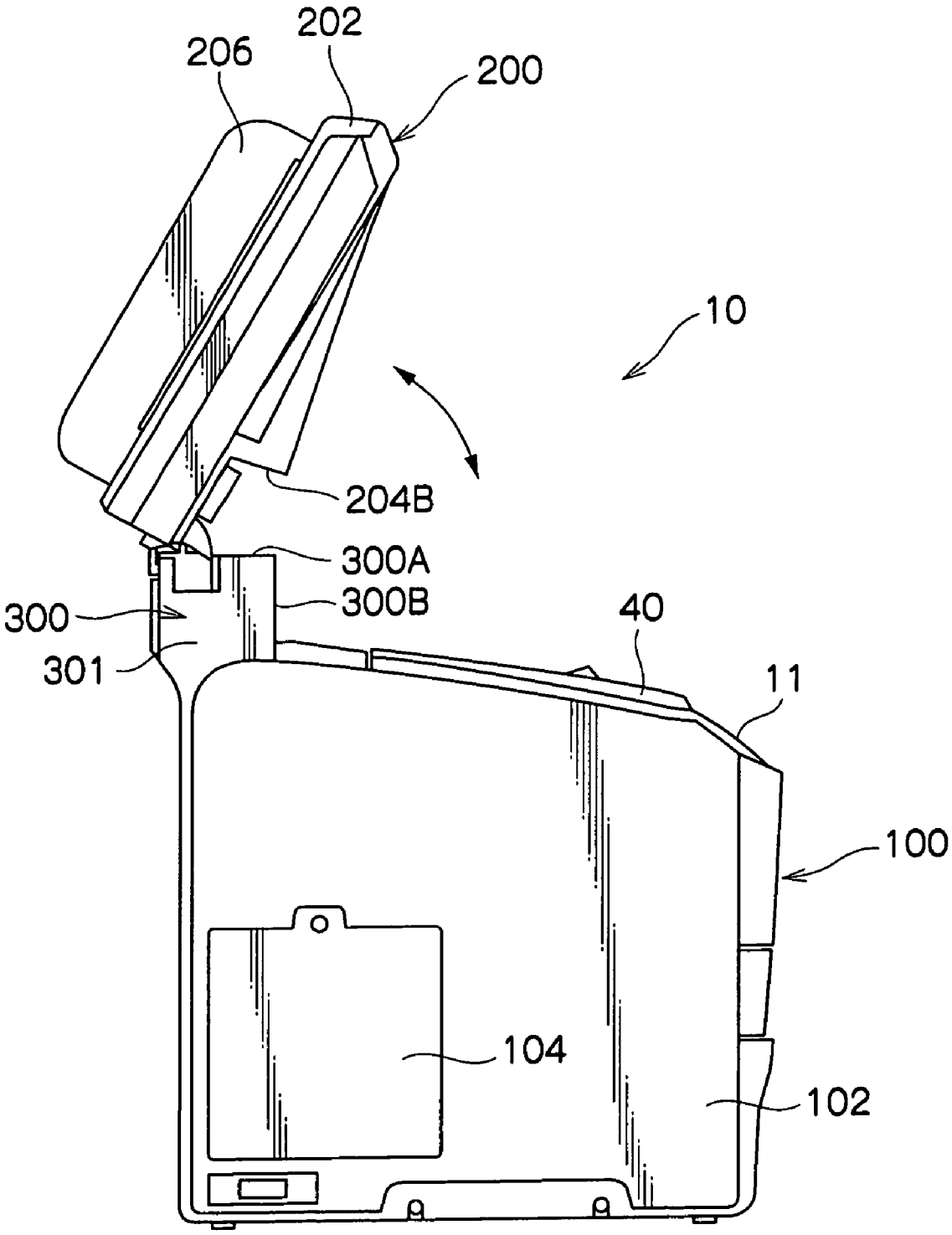
FIG. 5 is a side elevational view of a state in which the image reading unit of the digital copying machine is rotated so as to be opened.

Further, as shown in FIGS. 4, 5 and 12A-12B, two protruding portions 220 and 222 are provided at positions corresponding to the first column support portion and the second column support portion, in a lower surface of the image reading unit 200. The image reading unit 200 and the protruding portions 220 and 222 are coupled by hinges 224 and 226 (refer to FIG. 12A), and the image reading unit 200 can be rotated between positions in an approximately horizontal state (FIG. 4) and in an open state (FIG. 5). Further, as shown in FIG. 5, in a case that the whole body of the image reading unit 200 is rotated around the hinge so as to be opened, the image reading unit 200 is retracted from above the front face side of the image forming unit 100, and a space is formed above the front face side.

As shown in FIG. 17, the apparatus is configured such that when the image reading unit 200 is in approximately horizontal (closed) state, an upper surface 300A of the first column support portion 300 receives a lower surface 200A at a corner portion of the image reading unit 200, and a side surface 300B of the first column support portion 300 receives a side surface portion 204B of the downwardly extending portion 204. In this case, although an illustration will be omitted, in the opposite side surface, the apparatus is configured, in a same manner, such that an upper surface 302A of the second column support portion 302 receives the lower surface 200A at a corner portion of the image reading unit 200, and a side surface 302B of the second column support portion 302 receives a side surface portion 205B of the downwardly extending portion 205.

Next, description will be given for an outline of the structure of the image forming unit 100 and a process of forming a color image on a recording paper P.

As shown in FIG. 1, a photo sensitive drum 12 is rotatably arranged approximately at a center of the image forming unit 100. Further, a rotary type developing unit 50 is arranged at a front face side (a right side in the drawing) of the image forming unit 100.

The photo sensitive drum 12 is rotated in a direction of an arrow A. Further, a surface of the photo sensitive drum 12 is electrically charged to a predetermined electric potential by a charging device 14 arranged at a lower side of the photo sensitive drum 12, and is thereafter exposed by a laser beam L irradiated from a light scanning unit 16 arranged at a lower side of the photo sensitive drum 12. Accordingly, a latent image is formed on the basis of a digital image data of the original read by the image reading unit 200 mentioned above.

The latent image formed on the surface of the photo sensitive drum 12 is developed by respective color developing devices 52Y, 52M, 52C and 52K of magenta (M), yellow (Y), cyan (C) and black (K) arranged along a peripheral direction of the rotary type developing unit 50, thereby a predetermined color toner image is formed. In this case, the respective developing devices 52Y, 52M, 52C and 52K are provided with replaceable toner cartridges 54Y, 54M, 54C and 54K.

A toner image formed on the surface of the photo sensitive drum 12 is primarily transferred to an intermediate transfer belt 30 which is tensioned between a plurality of rolls 18 and a transfer roll 35 and is rotating in a direction of an arrow C. In this case, a non-transferred residual toner left on the surface of the photo sensitive drum 12 without being primarily transferred is removed by a photo sensitive drum cleaning unit 20.

In this case, the rotary type developing unit 50 is rotated in a direction of an arrow B around a rotation axis K, developing rolls 56Y, 56M, 56Y and 56K of the developing devices 52Y, 52M, 52C and 52K which the color thereof correspond to the colors of the formed image are moved sequentially to perform development of the respective colors.

Respective steps of electrically charging, exposing, developing, primarily transferring and cleaning of the photo sensitive drum are repeated at a predetermined frequency in correspondence to the color of the formed image. The respective color toner images are multiply transferred to the intermediate transfer belt 30 so as to be overlapped with each other, and thereby a full color image is formed.

A paper feeding cassette 22 in which the recording paper P is received is arranged at a lower portion of the image forming unit 100.

The recording paper P is fed by a paper feeding roller 24, and is fed to a secondary transfer position T at a predetermined timing by a resist roller 33, and a full color toner image of the intermediate transfer belt 30 is secondarily transferred to the recording paper P in a lump by a secondary transfer roll 32 and a transfer roll 35. In this case, a non-transferred residual toner of the intermediate transfer belt 30 which is left without being secondarily transferred is removed by a transfer belt cleaning unit 37.

The recording paper P to which the full color toner image is transferred is fed to a fixing device 36 disposed at an upper portion at a back face side. The fixing device 36 fixes the full color toner image to the recording paper P by heat and pressure. The recording paper P to which the full color toner image is fixed is discharged to a paper discharge tray 40 at an upper portion of the image forming unit 100.

Figure 11:
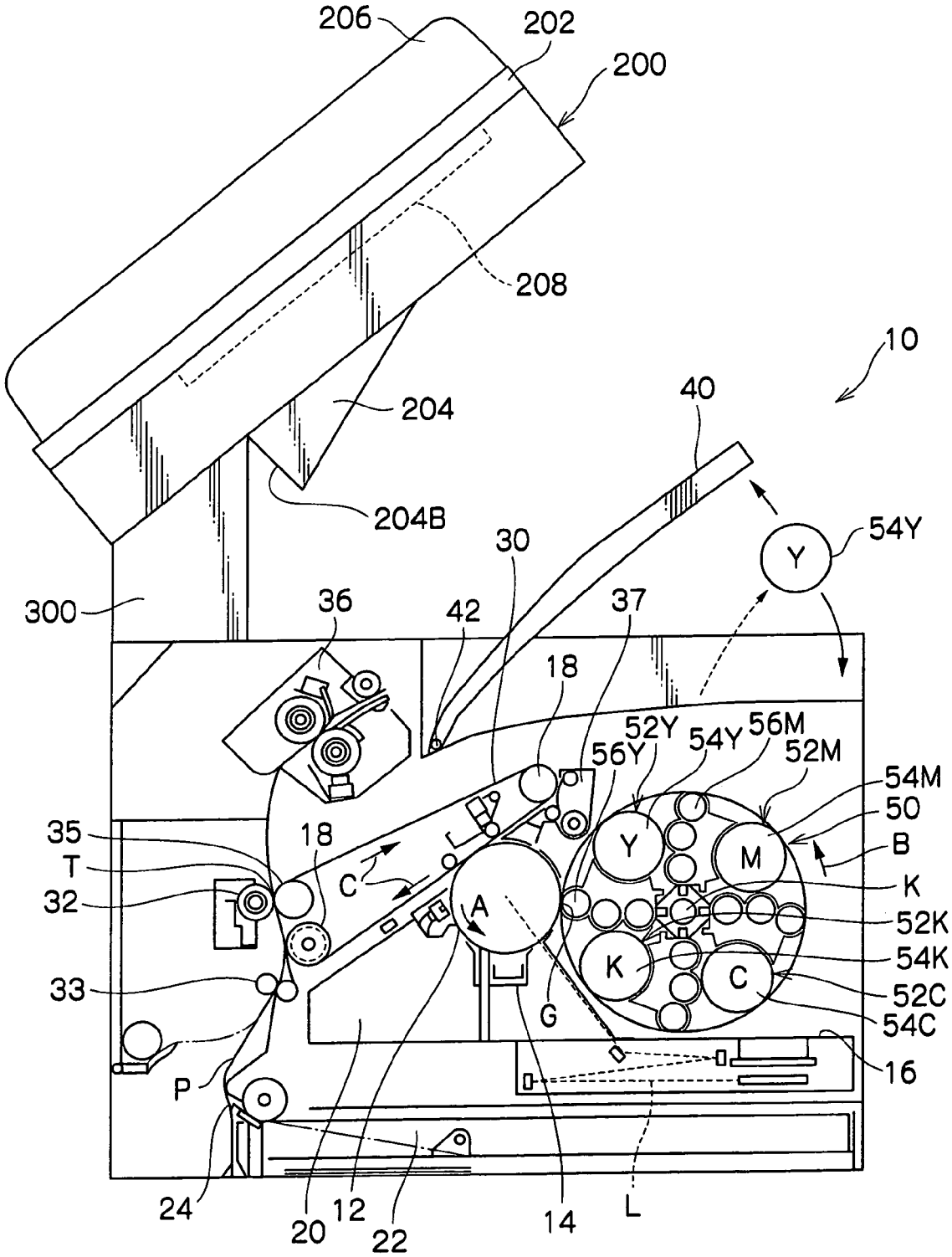
FIG. 11 is a schematic view showing a state in which a paper discharge tray is opened in a state that the image reading unit of the digital copying machine is rotated to be opened, and a toner cartridge is replaced.

In this case, as shown in FIG. 5, when the whole body of the image reading unit 200 is rotated so as to be retracted from above the front face side of the image forming unit 100, a space is formed above the front face side of the image forming unit 100. Further, as shown in FIG. 11, the toner cartridge 54 can be replaced by rotating the paper discharge tray 40 around a rotation axis 42 of an end portion at a back face side so that the paper discharge tray 40 is opened. Although FIG. 11 shows a case of replacement of the toner cartridge 54Y, it is possible to replace the other toner cartridges 54M, 54C and 54K by rotating the rotary type developing unit 50 and moving the respective developing devices 52 to replaceable positions.

Figure 6:
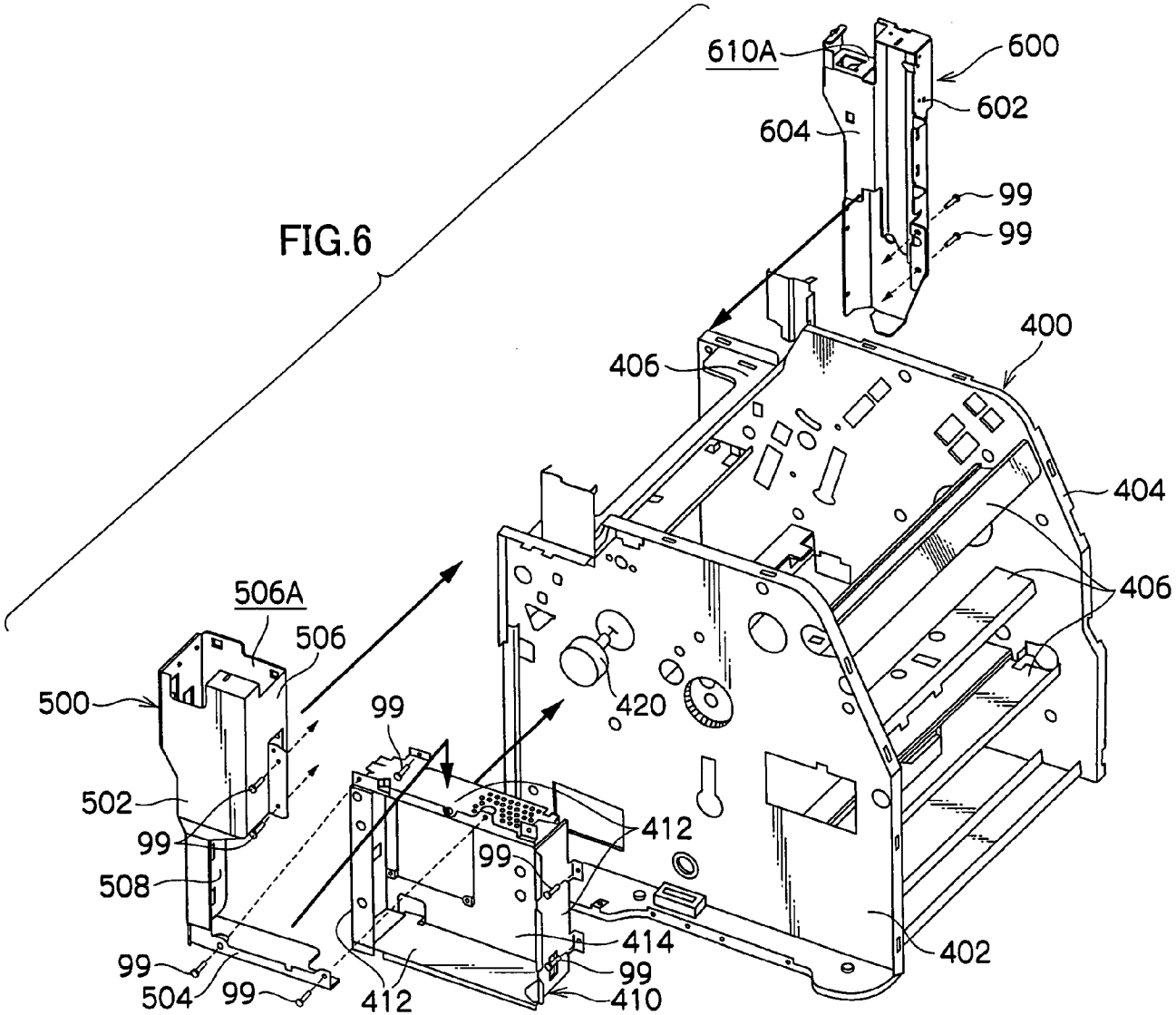
FIG. 6 is an exploded view showing a frame structure of the digital copying machine.
Figure 7:
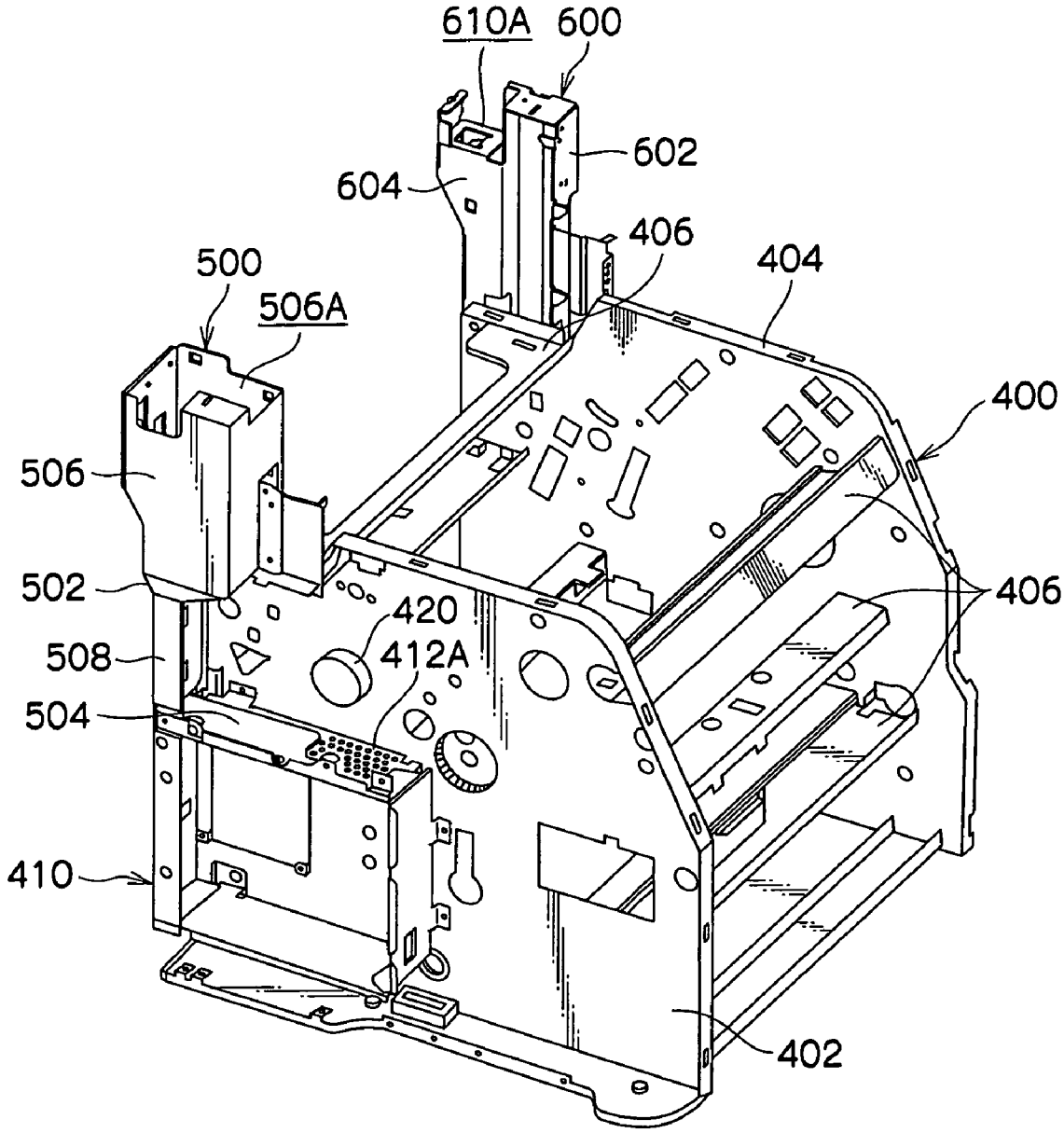
FIG. 7 is a view showing the frame structure of the digital copying machine.
Figure 8:
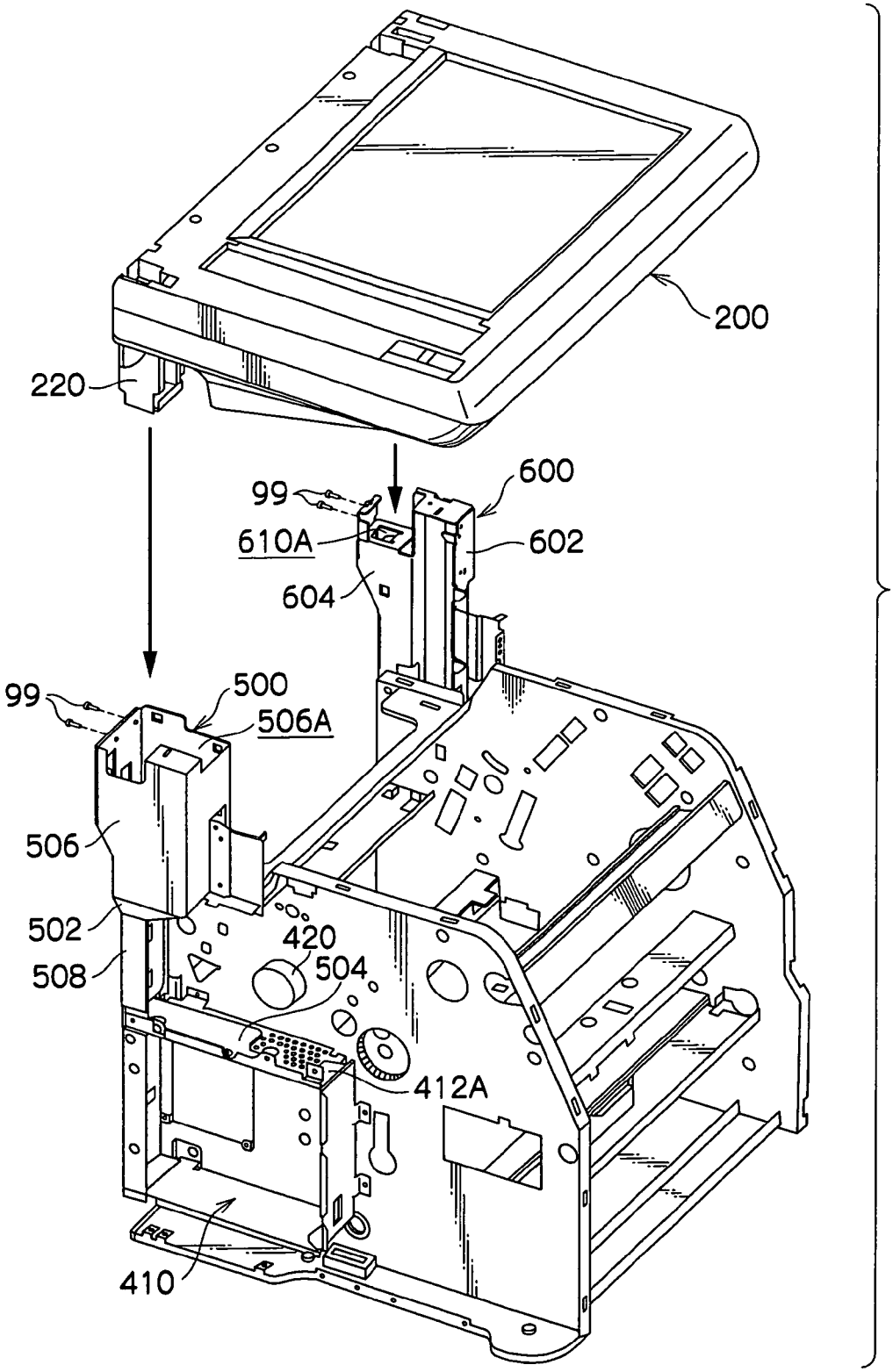
FIG. 8 is a view showing a state in which the image reading unit is attached to a first column support and a second column support.

Next, description for a support structure (a frame structure) of the image reading unit 200 of the digital copying machine 10 will be given. FIGS. 6, 7 and 8 are views showing a state in which various covers of the image forming unit 100 are taken off.

In the following description, there is description relating to fixing by screws 99. In the drawings corresponding to this description, in order to prevent the drawings from being complicated and difficult to view, only some representative screws 99 (and screw holes) are illustrated, instead of illustrating all of the screws 99 (and screw holes), and the other screws 99 are omitted in the illustration.

As shown in FIGS. 2 and 7, the first column support portion 300 is provided with a first column support 500 (refer to FIG. 7) in an inner portion thereof, and a first column support cover 301 covers the first column support 500. Similarly, the second column support portion 302 is provided with a second column support 600 (refer to FIG. 7) in an inner portion thereof, and a second column support cover 303 covers the second column support 600.

As shown in FIGS. 6 and 7, a casing 400 of the image forming unit 100 is constituted by side plates 402 and 404 which face to each other, and are made of metal sheet, and a plurality of bridge plates 406 bridged between the side plates 402 and 404.

A box-shaped box portion 410 is fixed to the side plate 402 on the one side. The box portion 410 is constituted by four side wall portions 412 and a bottom surface portion 414. In this case, the box portion 410 is fixed by screws 99 in a manner such that the bottom surface portion 414 faces the side plate 402. Thus, the side wall portions 412 are structured so as to rise up from the side plate 402. A power source circuit board (not shown) is attached to an inner side of the box portion 410. The power source circuit board can be easily replaced by detaching a detachable power source cover 104 from a casing cover 102 covering the side plate 402 as shown in FIG. 4.

As shown in FIGS. 6 and 7, a drive motor 420 is fixed above the box portion 410. Further, a gear mechanism (not shown) constituted by a plurality of gears to which a drive force from the drive motor 420 is transmitted is fixed to a back side of the side plate 402 (an inner portion of the casing 400).

The first column support 500 formed by bending a plurality of metal sheets is fixed to the side plate 402. The first column support 500 is constituted by a first support portion 502 and a second support portion 504 extending in a horizontal direction (parallel to the image reading unit 200) from a lower portion of the first support portion 502, and is overall formed in substantially an L shape. The first support portion 502 is constituted by a hollow first box portion 506 having a square pole shape and having an open upper portion, and a hollow second box portion 508 provided at a lower portion of the first box portion 506 and having a square pole shape narrower than the first box portion 506. In both of the first box portion 506 and the second box portion 508, a vertical direction corresponds to a longitudinal direction thereof. The second support portion 504 is formed in a plate shape, and extends in a horizontal direction from a lower portion of the second box portion 508.

The first support portion 502 is fixed to the side plate 402 by the screws 99. The second support portion 504 is lapped over a side wall portion 412A forming an upper surface of the box portion 410, and is fixed by the screws 99. Further, the second support portion 504 is fixed where avoiding the drive motor 420 so that it is prevented from interfering with the drive motor 420.

The second column support 600 is fixed to the side plate 404 on the other side by the screws 99. Since the box portion 410 and the drive motor 420 are not fixed to the side plate 404 unlike the side plate 402, the second column support 600 extends straight to the lower portion of the side plate 404.

Figures 9A, 9B, 9C:
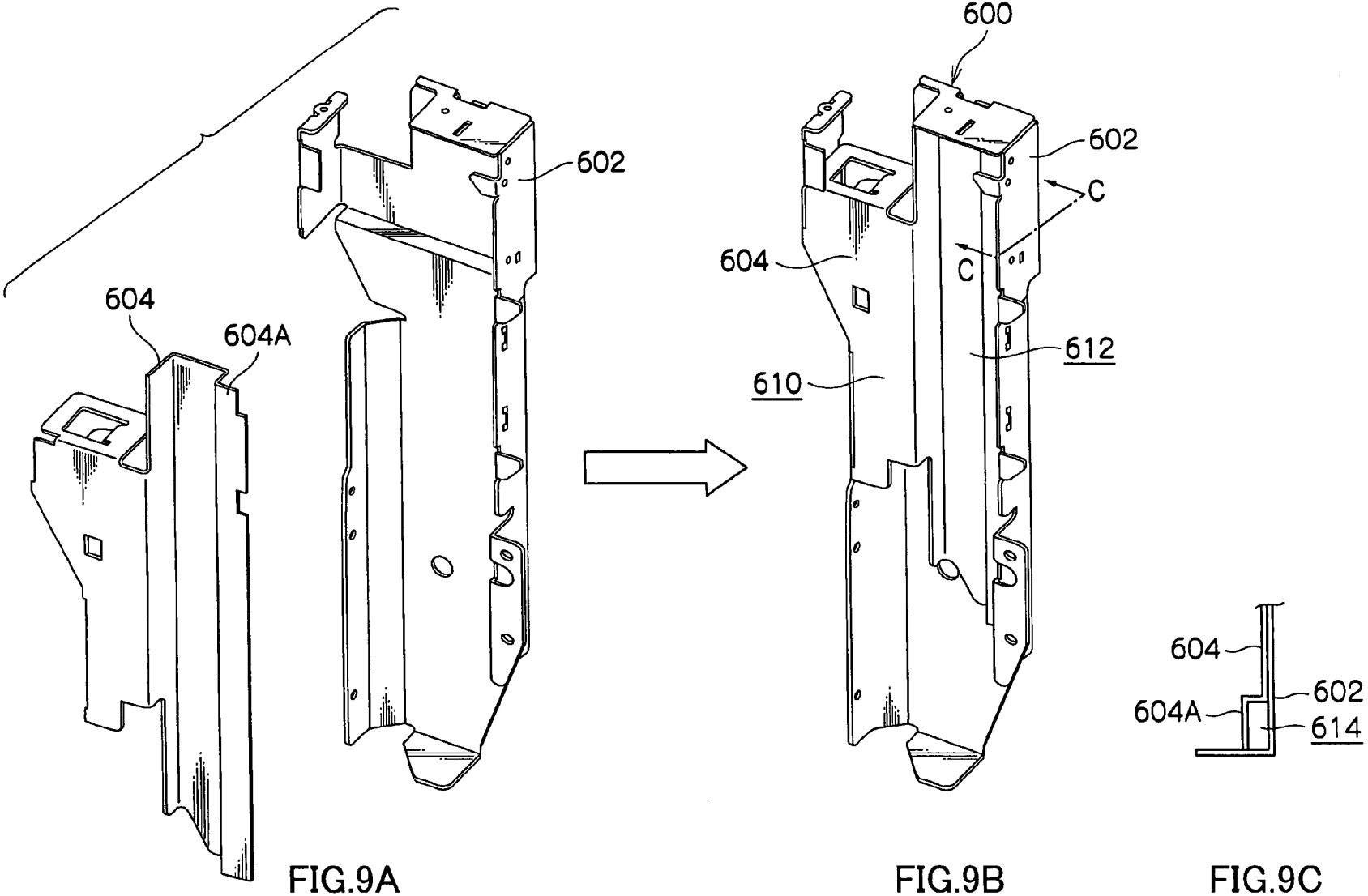

As shown in FIGS. 9A to 9B, the second column support 600 is structured such that two metal sheets 602 and 604 which are formed by bending processing are fitted together and fixed by the screws 99, thereby forming in a hollow, and substantially square pole shape. An upper portion of the second column support 600 is divided into two chamber portions 610 and 612. Further, as shown in FIG. 9C, an end side portion 604A of the metal sheet 604 is bent so as to form a prismatic portion 614 having a hollow square pole shape when the metal sheet 604 is fitted together with the other metal sheet 602. In both of the second column support 600 and the prismatic portion 614, a vertical direction corresponds to a longitudinal direction thereof.

Figure 10:
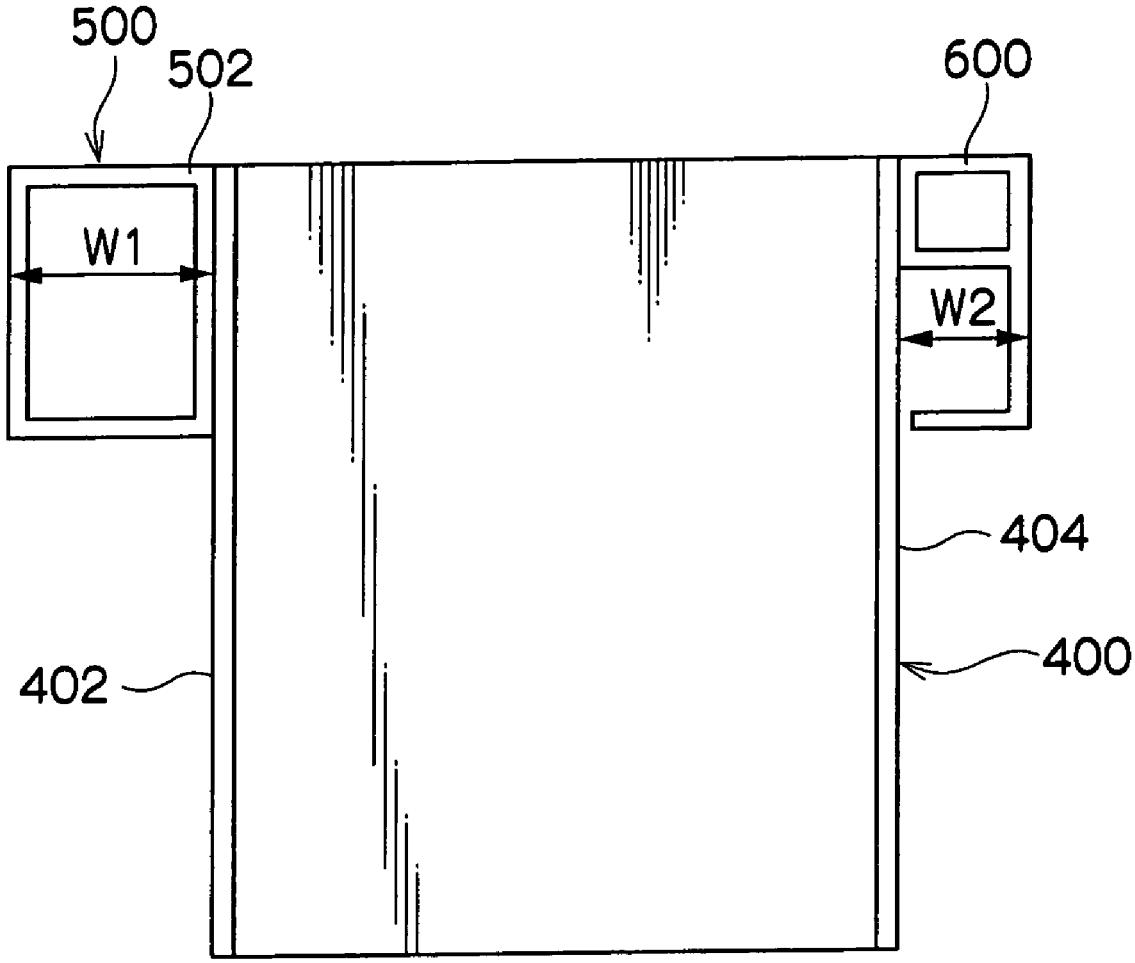
FIG. 10 is a schematic view showing a difference of thickness in cross sections of a first support portion of the first column support, and the second column support.

As shown in FIG. 10, a horizontal cross section of the first box portion 506 of the first support portion 502 of the first column support 500 is larger (thicker) than a horizontal cross section of the second column support 600. In this case, widths of the first column support 500 and the second column support 600 in a front-back direction of the apparatus are substantially equal; however, the first column support 500 is wider in a lateral direction. In the present embodiment, a width W1, in the lateral direction, of the first box portion 506 of the first support portion 502 in the first column support 500 is about twice a width W2 of the second column support 600.

Figures 12A, 12B:
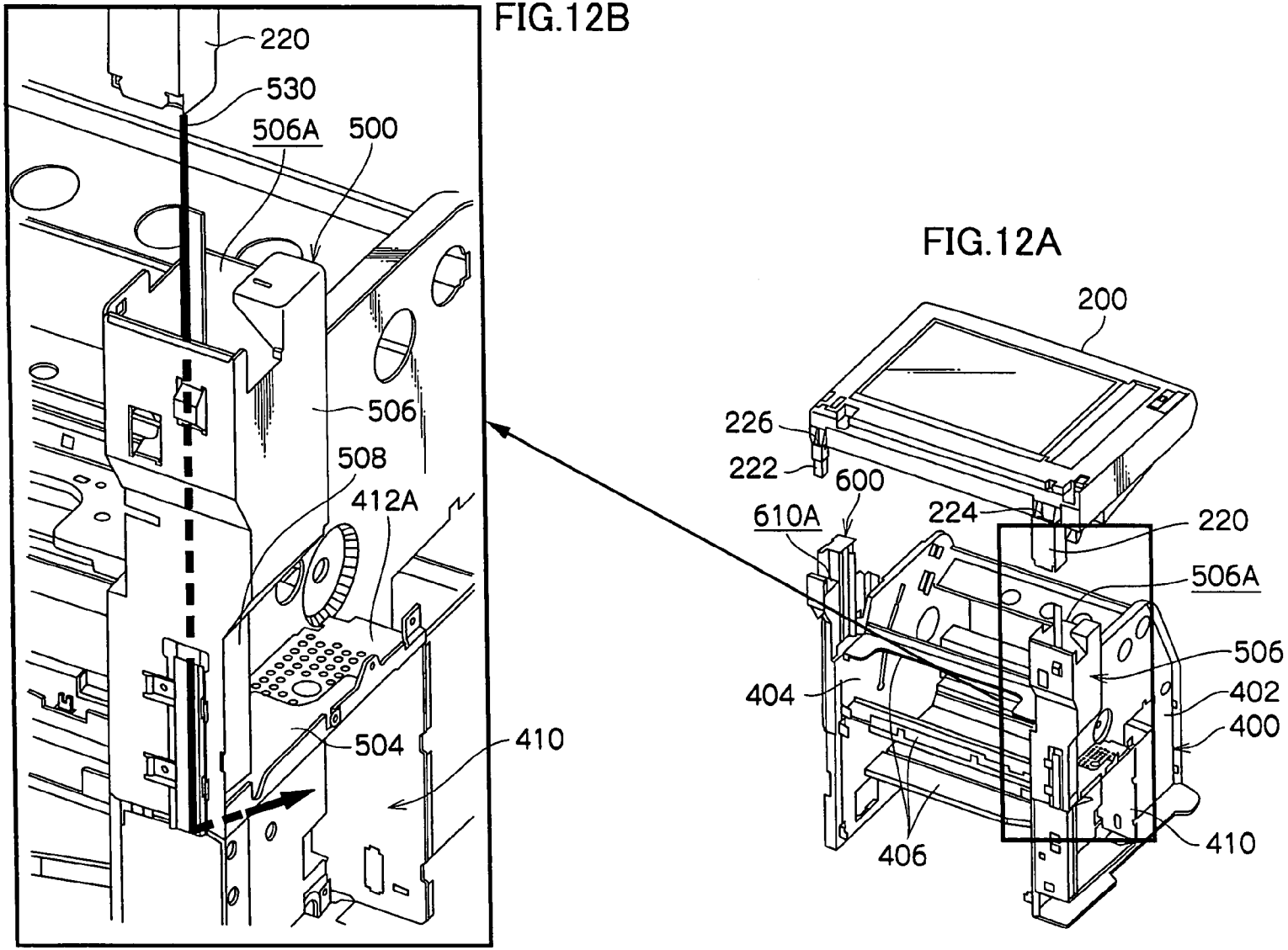

As shown in FIGS. 8 and 12A, two protruding portions 220 and 222 (refer to FIG. 12A) protruding toward a lower side from corner portions at the back face side of the image reading unit 200 are inserted into an upper opening 506A of the first box portion 506 of the first column support 500 and an upper opening 610A of the second column support 600, and fitted to the first box portion 506 and the first chamber portion 610, and are fixed by the screws 99. In accordance with this structure, the first column support 500 and the second column support 600 support the image reading unit 200 in a cantilever manner.

In this case, the image reading unit 200 is formed rigidly in order to support the heavy copy table 208, the scan driving mechanism 212, the automatic original feeding unit 206 (refer to FIG. 2) and the like. Further, inside of the image reading unit 200, a reinforcing member such as a beam, a metal sheet or the like is bridged between the two protruding portions 220 and 222 (refer to FIG. 12A) (i.e., between the first column support 500 and the second column support 600). Accordingly, the image reading unit 200 will not bend even though it is supported in a cantilever manner by the first column support 500 and the second column support 600 at the two corner portions as mentioned above.

Further, as shown in FIGS. 2 and 3, the automatic original feeding unit 206 and the scan driving mechanism 212 for driving the reading bar 210 as mentioned above are both arranged at the side plate 402 side. Accordingly, as shown in FIG. 3, a center of gravity Y2 of the image reading unit 200 is toward the side plate 402 side from a center line Y1 in a front view.

As mentioned above, the image reading unit 200 can rotate to be opened by the hinges 224 and 226 (refer to FIG. 12A), as shown in FIGS. 4 and 5.

As shown in FIGS. 12A to 12B, an electric wire 530 connecting a power source circuit board (not shown) attached to the box portion 410 mentioned above and the image reading unit 200 is passed though an inner portion of the first column support 500.

Further, as shown in FIG. 13, a detection switch 550 is attached to the inner portion of the first column support 500. The detection switch 550 detects an opening and closing operation of an opening and closing cover 552 provided at an outer side of the fixing device 36 (refer to FIG. 1) arranged in a back face side upper portion of the image forming unit 100. In particular, as shown in FIG. 14, it is configured such that a projection portion 554 formed in the opening and closing cover 552 turns on and off the detection switch 550 in accordance with the opening and closing operation of the opening and closing cover 552. If the opening and closing cover 552 is opened (a state shown in FIG. 14), the power source is turned off.

As shown in FIG. 4, the casing 400 is entirely covered by the casing cover 102. Further, the first column support 500 is covered with the first column support cover 301, and the second column support 600 is covered with the second column support cover 303 (refer to FIG. 2).

Figure 16:
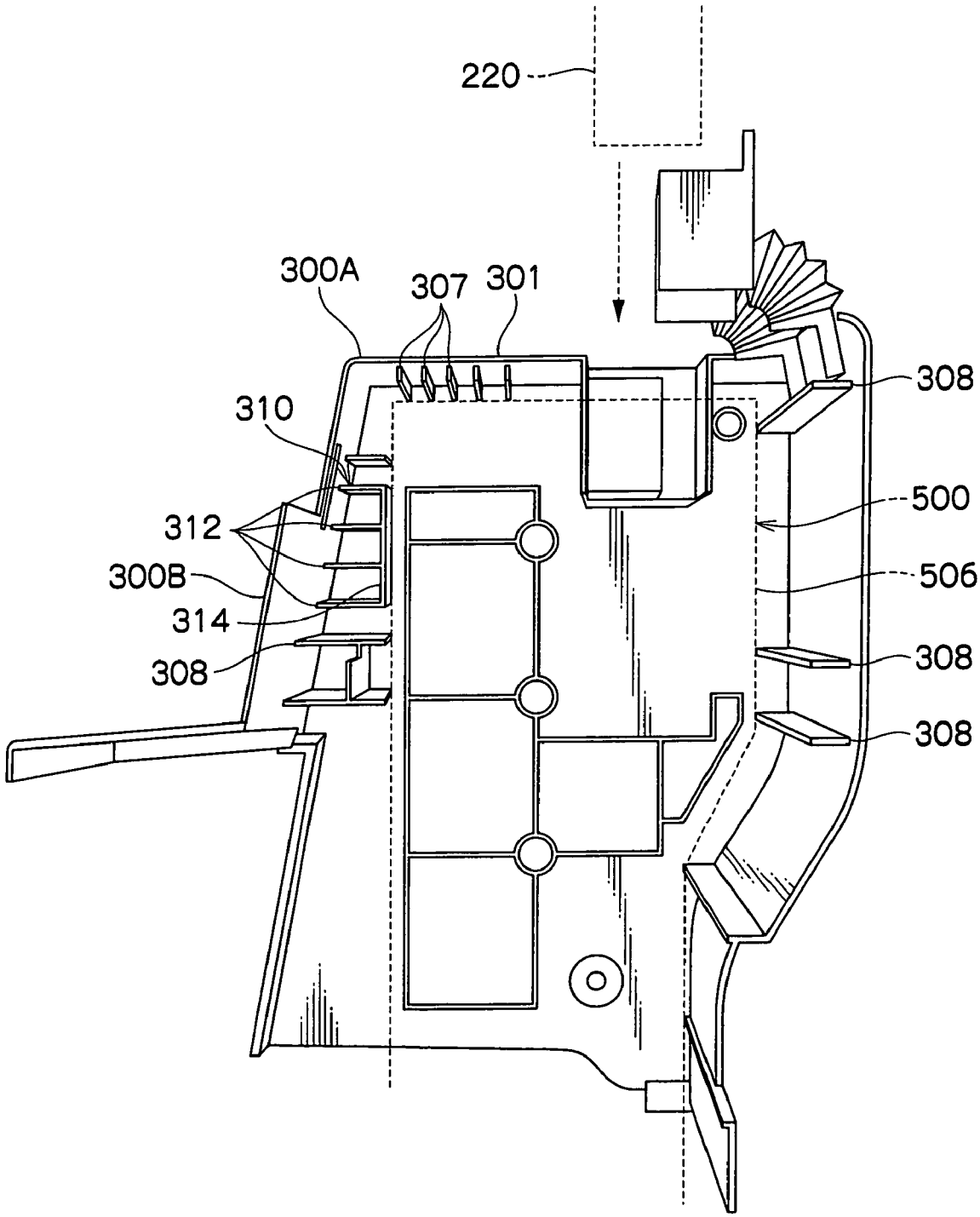
FIG. 16 is a view showing an inner wall of a first column support cover; and, FIG. 17A is a view of the image reading unit in approximately horizontal state.

FIG. 16 shows an inner side of the first column support cover 301. Since the second column support cover 303 has the same structure as the first column support cover 301, description and illustration thereof will be omitted.

A plurality of ribs 308 brought into contact with the first column support 500 are formed at an inner side wall of the first column support cover 301. Further, a rib 307 brought into contact with the upper surface of the first column support 500 is formed at an inner side of an upper surface of the cover 301. Further, a receiving rib 310 is formed at a side of a side surface 300B (refer to FIG. 17A) receiving the side surface 204B of the downwardly extending portion 204 of the image reading unit 200. The receiving rib 310 is constituted by a rib 314 abutting with the first column support 500 by a surface thereof, and a plurality of ribs 312 rising up between the rib 314 and the side surface 300B.

Next, an operation of the present embodiment will be described.

Figure 15:
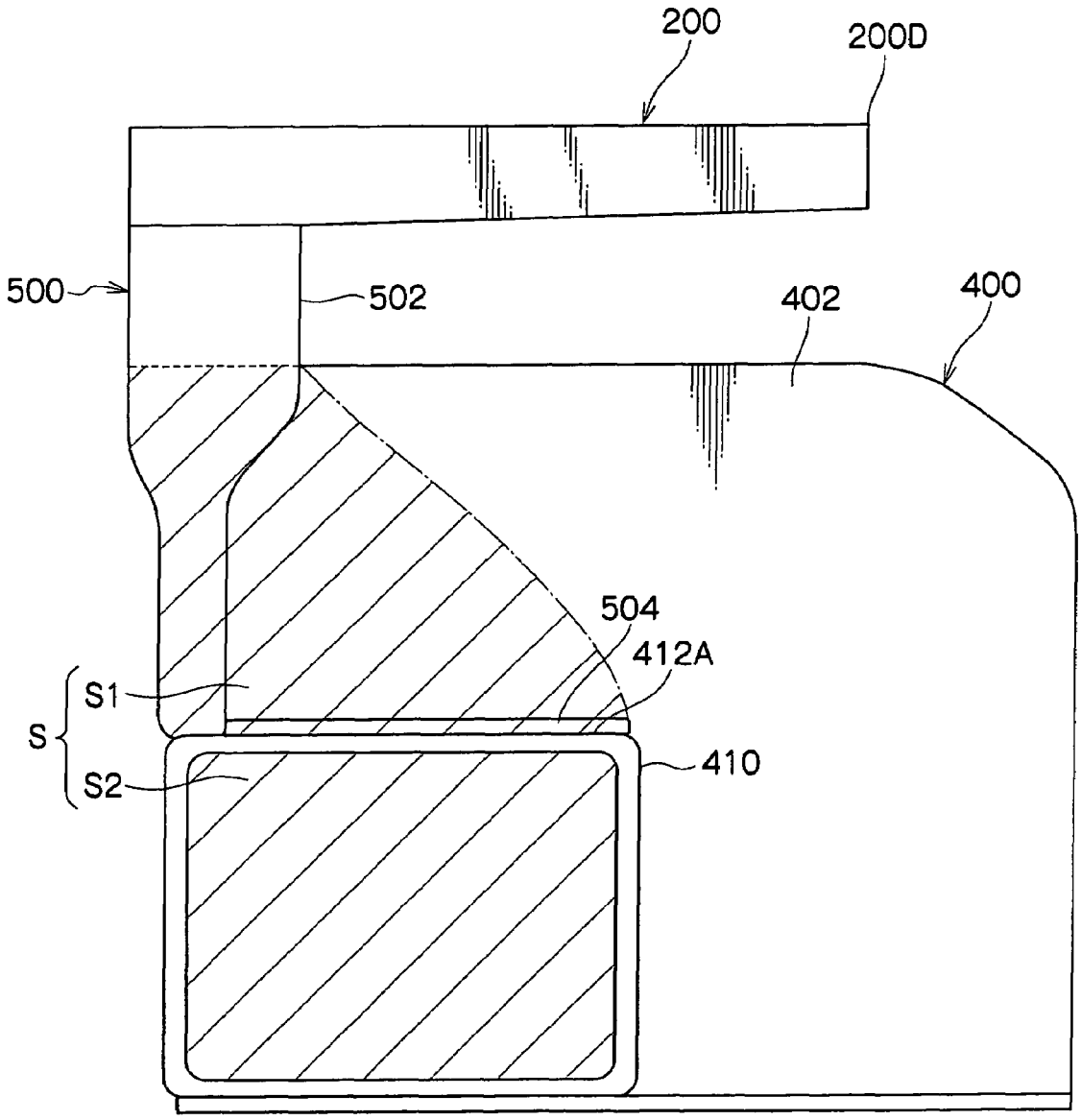
FIG. 15 is a side elevational view schematically showing a frame structure of the digital copying machine.

As shown in FIG. 17, the upper surface 300A of the first column support portion 300 receives the back face side corner portion of the image reading unit 200. Accordingly, a force rotating to the front face side around the upper surface 300A of the first column support portion 300 will be applied to the image reading unit 200. However, the side surface 204B of the downwardly extending portion 204 of the image reading unit 200 is received and supported by the side surface 300B of the first column support portion 300 which is positioned further toward the front face side than the upper surface 300A. Further, since a supporting point (the upper surface 300A) serving as a center of rotation, and the side surface 300B receiving the side surface 204B of the downwardly extending portion 20A serving as a action point are apart from each other, a moment will be increased. Accordingly, the image reading unit 200 can be supported even if a great force is applied in the rotating direction, that is, even if the image reading unit 200 has a heavy weight, and even if a load is applied to the front face side end portion 200D of the image reading unit 200 as shown in FIG. 15. Thus, it is possible to maintain a position at which the image reading unit 200 is in substantially horizontal state. Further, for example, it is not necessary to independently provide a loading portion for loading the image reading unit 200, and the structure of the first column support portion 300 can be simple.

Since the rib 307, the rib 308, and the receiving rib 310 are formed at the first column support cover 301 as shown in FIG. 16, the upper surface 300A and the side surface 300B of the first column support portion 300 will not deform even if the load of the image reading unit 200 is applied thereto, and can receive the load mentioned above. In particular, although a great load is applied to the side surface 300B, however, the load can be received by the receiving rib 310 without the side surface 300B deforming.

The above description has been given with respect to the first column support portion 300. However, the same operation can be achieved at the second column support portion 302 in the opposite side surface.

Further, as shown in FIGS. 3 and 4, a space is maintained between the image forming unit 100 and the image reading unit 200 except the portion between the downwardly extending portions 204 and 205, and the first column support portion 300 and the second column support portion 302 (a portion R surrounded by a dotted line in FIGS. 3 and 4). Accordingly, it is easy to take out the recording paper P discharged to the paper discharging tray 40, and therefore a structure is excellent in design.

Further, as schematically shown in FIG. 15, the first support portion 502 is fixed to the side plate 402, and the second support portion 504 extending in substantially horizontal direction (parallel to the image reading unit 200) is fixed to the box portion 410 fixed to the side plate 402. Accordingly, the box portion 410 supports the image reading unit 200 integrally with the first column support 500. Namely, the box portion 410 also forms a part supporting the image reading unit 200. Since the image reading unit 200 is supported by a wide region S comprising an approximately triangular region S1 constituted by the first support portion 502 and the second support portion 504, and a square region S2 of the box portion 410, a strain is hard to be generated in the side plate 402 even if the first column support 500 is fixed to the side plate 402. Thus, even if the first column support 500 is fixed to the side plate 402, a reduction of image quality due to the strain of the casing 400 of the image forming unit 100 will not be generated.

Further, the second support portion 504 extends in a horizontal direction, and the side wall portion 412A forming the upper surface of the box portion 410 receives the force such that the first column support 500 is to be falling toward the front face side (a right side in FIG. 15). Accordingly, even if a force such that the image reading unit 200 is to be falling down toward the front face side will act, it is possible to support the image reading unit 200. Further, even if the load is applied to the front face side end portion 200D of the image reading unit 200, the first column support 500 will not easily fall down. Furthermore, as mentioned above, the side plate 402 is hard to be strained.

Since the first column support 500 is structured such as to be firmly fixed to the side plate 402, it is not necessary to provide a beam or the like for bridging the first column support 500 and the second column support 600.

Most of the load of the image reading unit 200 is supported by firmly fixing the first column support 500 to the side plate 402. Accordingly, it is unnecessary to fix the second column support 600 as firmly as the first column support 500. Accordingly, as shown in FIG. 6, there is no problem even if the second column support 600 is not provided with the second support portion 504 in contrast to the first column support 500. In other words, since the second column support 600 can be formed in an optional shape, a flexibility of the design is improved.

Figures 13A, 13B:
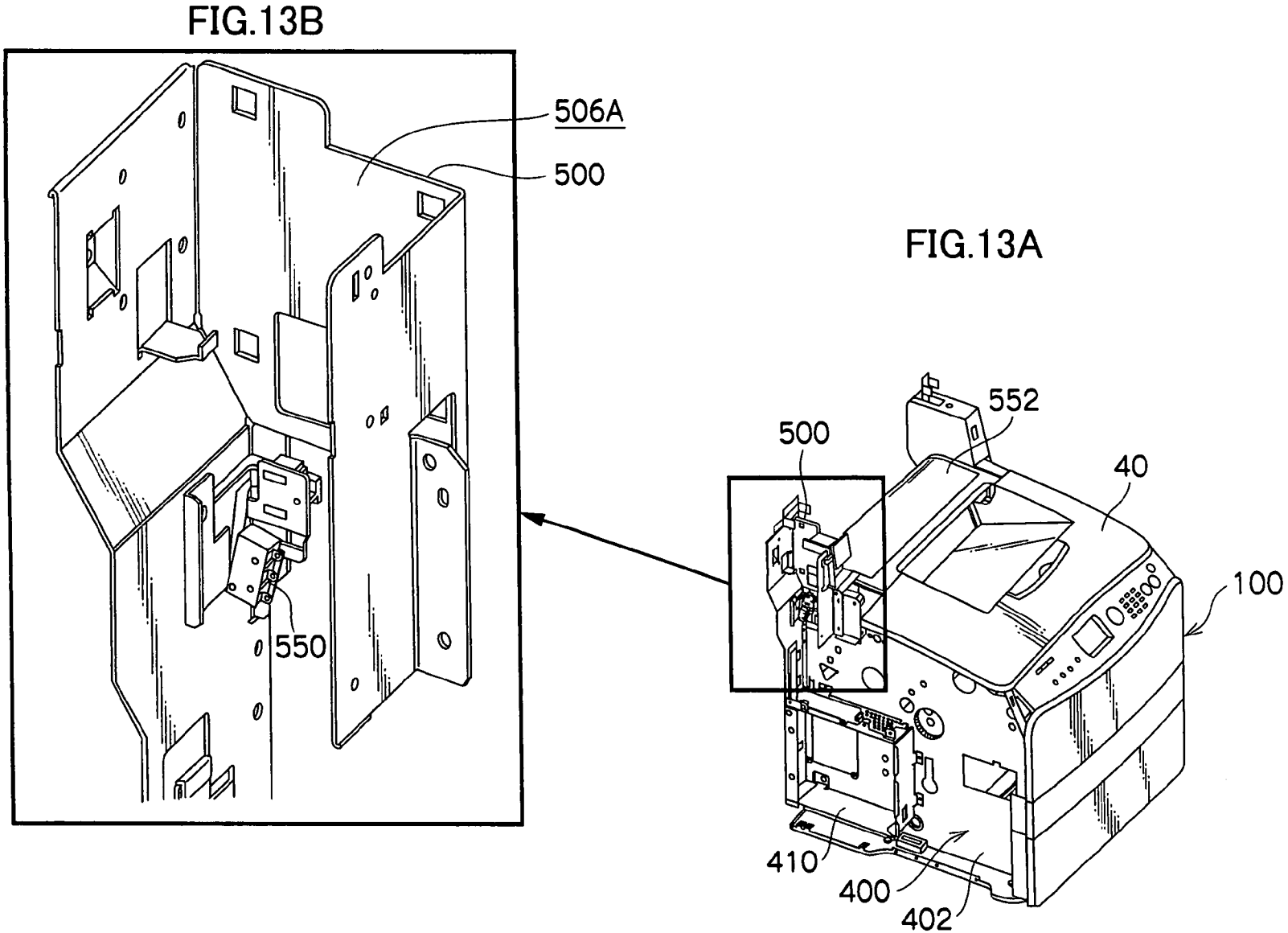
FIG. 13A is a view showing a state in which the image reading unit is not attached.
FIG. 13B is an enlarged view of a square portion in FIG. 13A.
Figure 14:
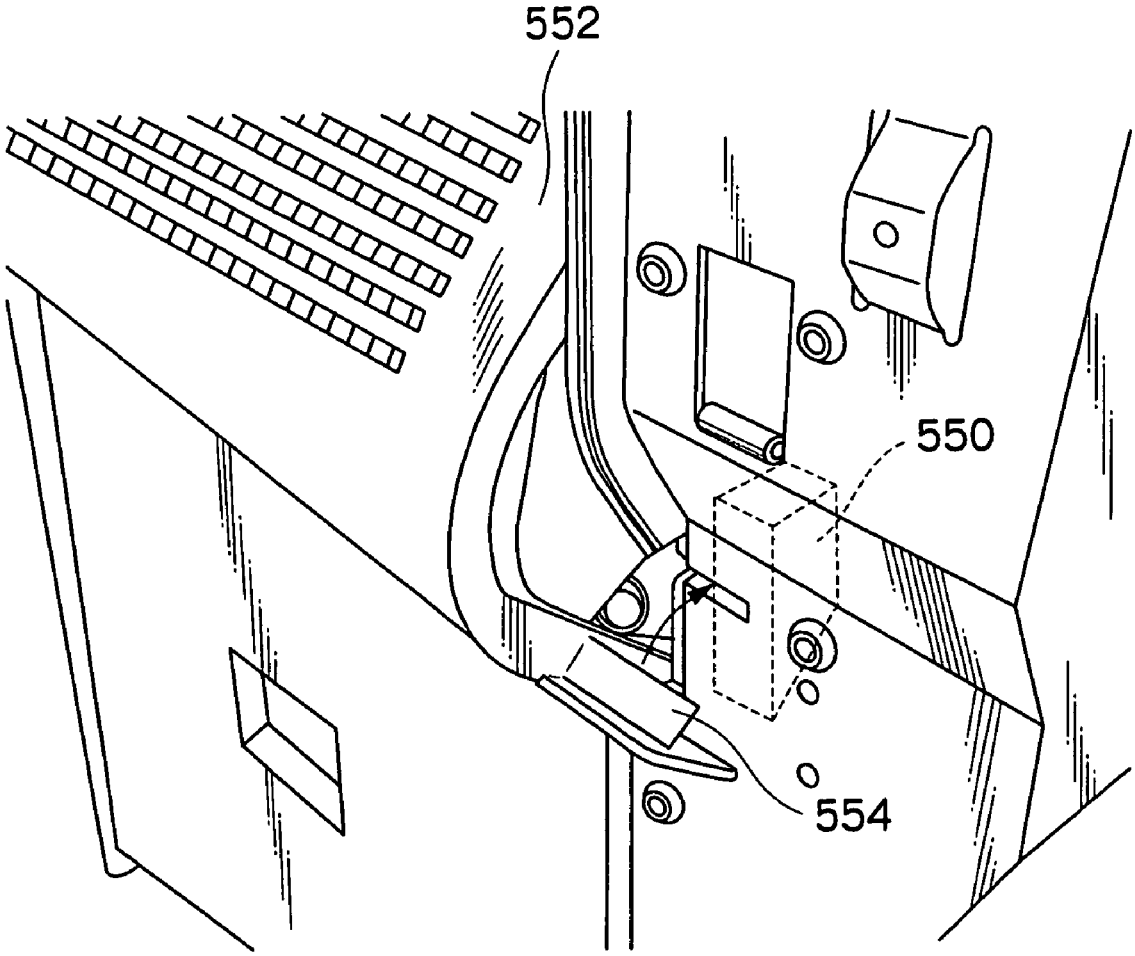
FIG. 14 is a view showing a state in which a switching cover of a fixing device is opened.

As shown in FIGS. 12A to 12B, the electric wire 530 can pass through the inner portion of the first column support 500, and as shown in FIGS. 13A to 13B, the detection switch 550 is attached to the inner portion of the first column support 500. Accordingly, there is no need to independently provide an attaching space of the detection switch 550 or a wiring space for the electric wire 530. In other words, a space saving is achieved.

Figure 17A:
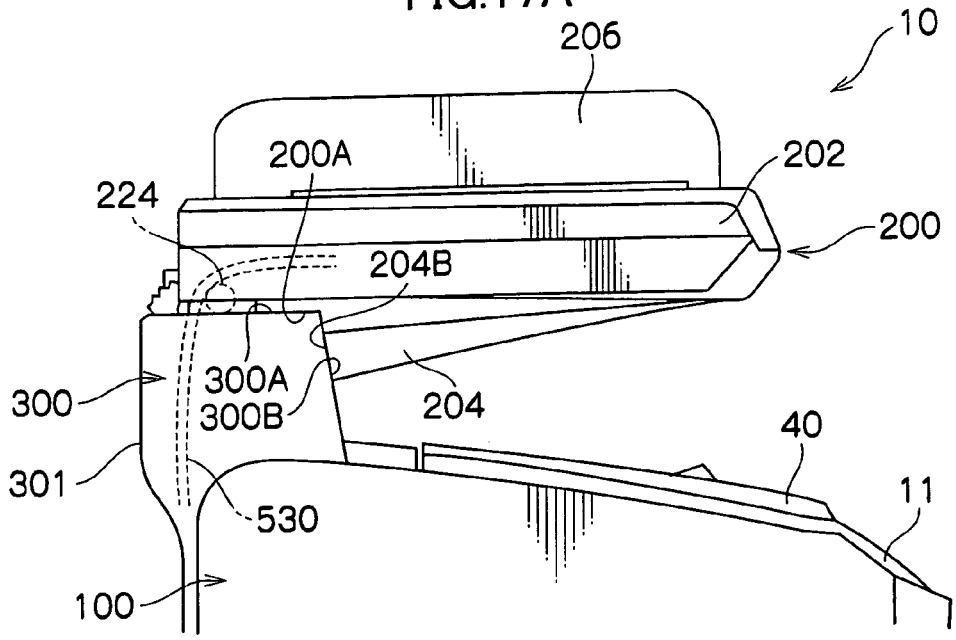
FIG. 17B is a view of the image reading unit rotated so as to be an opened state.
Figure 17B:
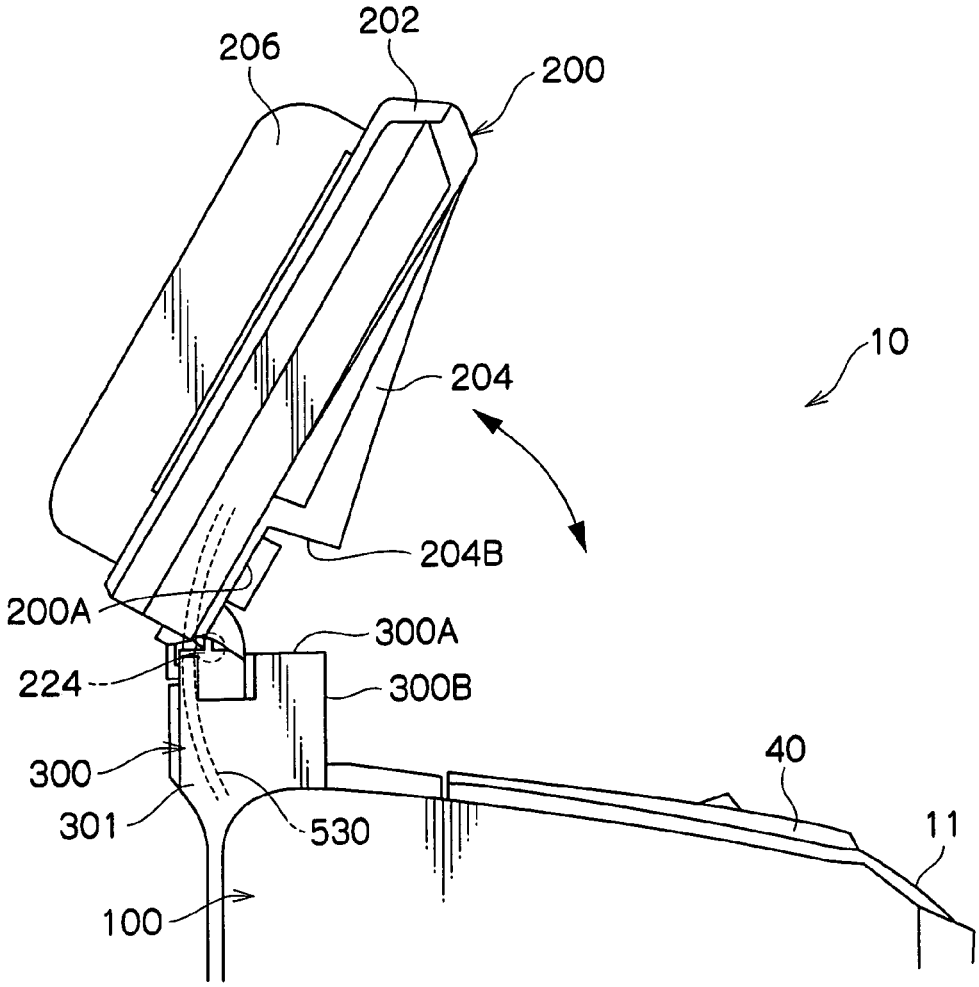

Further, as shown in FIGS. 17A to 17B, since the electric wire 530 is wired through a portion near the hinge 224, a difference of necessary length for the electric wire 530 will be small between a state (FIG. 17B) in which the image reading unit 200 is opened and a horizontal state (FIG. 17A). Accordingly, even if the image reading unit 200 is rotated, the deflection of the electric wire 530 will be small. Therefore, the electric wire 530 will not bend (buckled) and be damaged. Further, it is easy to arrange (wire) the electric wire 530. Further, since the electric wire 530 is not exposed, an outer appearance will be preferable.

The apparatus in accordance with the present embodiment can be easily assembled by fixing the first column support 500 and the second column support 600 to the side plate 402 of the casing 400 of the image forming unit 100 by the screws 99, inserting and fitting two protruding portions 220 and 222 protruding toward the lower side from the corner portion at the back face side of the image reading unit 200 to the upper opening 506A of the first column support 500 and the upper opening 610A of the second column support 600, and fixing them by the screws 99. Further, since the image reading unit 200 and the protruding portions 220 and 222 are fixed by the hinges 224 and 226, it is possible to perform an assembling operation (an inserting operation) in a state in which the image reading unit 200 is set in desired attitude, for example, in a rising up attitude, at a time of inserting operation, so that the operation can be easily performed.

Further, the image reading unit 200 can be attached by using the casing 400 of the image forming unit 100 as it is. Accordingly, it is possible to provide digital copying machine 10 in low cost.

In other words, it is easy to provide the image forming unit 100 itself as a printer without attaching the image reading unit 200, the first column support 500 and the second column support 600. Further, it is possible to easily extend to the digital copying machine 10 by attaching the image reading unit 200 to the image forming unit 100 as in the present embodiment.

Since all of the parts are fixed by the screws 99, they can be easily detachable (decomposable). This structure is preferable at a time of repair and maintenance.

As explained above, the invention provides an image forming apparatus provided with an image reading unit; an image forming unit; and a column support portion supporting the image reading unit in a cantilever manner so that a space is provided between the image reading unit and an upper surface of the image forming unit, and receives the image reading unit at the upper surface and the side surface thereof.

In the image forming apparatus, the image reading unit may be provided with a downwardly extending portion extending downward from a lower surface of the image reading unit, the column support portion receives the lower surface of the image reading unit at the upper surface thereof, and the downwardly extending portion of the image reading unit is received at the side surface thereof.

In other words, it is structured such that the load of the image reading unit is received by the upper surface and the side surface of the column support portion. Accordingly, it is not necessary to independently provide, for example a load portion for loading the image reading unit, and the structure of the column support portion can be simple.

In this case, since the supporting point serving as the center of rotation of the image reading unit and the side surface receiving the downwardly extending portion serving as the action point are apart from each other, the moment will be increased. Accordingly, even if a large force is applied in the rotating direction of the image reading unit, that is, even if the image reading unit has a heavy weight, it is possible to support the image reading unit.

Further, a structure is made such that a space is formed between the image forming unit and the image reading unit, except at the column support portion. In accordance with this structure mentioned above, for example, it becomes easy to pick up a paper discharged to the space between the image forming unit and the image reading unit, and the structure can be excellent in design.

A structure may be made such that the image reading unit is coupled to the column support portion by the hinge and is structured such as to be upwardly rotatable from the approximately horizontal state, and the side surface of the column support portion receives the downwardly extending portion of the image reading unit at a position at which the image reading unit is in an approximately horizontal state.

In the image forming apparatus having a structure as mentioned above, the image reading unit cab be retracted by rotating upwardly from the approximately horizontal state. Accordingly, it is possible to utilize the retracted space, for example, for replacing renewal parts or the like.

Further, the horizontal state can be easily maintained since the side surface of the column support portion receives the downwardly extending portion of the image reading unit at a position at which the image reading unit is in the approximately horizontal state.

The column support portion may be provided with an insertion portion into which a convex portion formed in the image reading unit can be inserted.

In accordance with this structure, the image forming apparatus can be assembled by inserting the convex portion formed in the image reading unit into the insertion portion. Accordingly, it is easy to perform an assembling operation of the image reading unit.

The hinges may be configured to couple the image reading unit and the convex portion.

In accordance with this structure, since the image reading unit and the convex portion are coupled by the hinges, it is possible to take a desired attitude of the image reading unit at a time of inserting. Accordingly, the assembling operation (the inserting operation) can be easy.

Further, the structure is made such that the column support portion may be fixed to a side surface of a casing of the image forming unit, and include a first support portion supporting the image reading unit and having the insertion portion, and a second support portion extending from the first support portion in a horizontal direction parallel to the image reading unit which is arranged in the cantilever manner, and the receiving portion for fixing the second support portion may be provided at the side surface of the casing.

In accordance with this structure, since a force will be applied to the approximately triangular region formed by the first support body portion and the second support portion, at the side surface of the casing, the side surface of the casing will not easily be strained. Further, even if a force is applied in the direction in which the support body falling down, the receiving portion receives the second support portion, therefore the side surface of the casing will not easily be strained. In other words, even if the support body supporting the image reading unit is fixed to the side surface of the casing of the image forming unit, the side surface of the casing will not easily be strained.

The receiving portion may formed as a frame body fixed to, and rising up from the side surface of the casing, and the second support portion may be fixed to the frame body.

In accordance with this structure, the frame body can be integrally formed with the support body so as to support the image reading unit.

Since the force due to the weight of the image reading unit will be applied to the region of the frame body in addition to the approximately triangular region constituted by the first support body portion and the second support portion, the side surface of the casing is more rigidly fixed, and the side surface of the casing further will not easily be strained.

In all of the structures mentioned above, the electric wire electrically connecting the image reading unit and the image forming unit may be wired to the inner portion of the column support portion.

In accordance with the structure mentioned above, there is no need to independently provide an arranging space for the wire, and it is possible to achieve space saving.

Further, in the case in which the image reading unit and the convex portion are coupled by the hinges, it is possible to wire the electric wire near the hinges serving as the center of rotation of the image reading unit. Accordingly, a difference of necessary length of the electric wire will be small between the state in which the image reading unit is opened, and the state in which the image reading unit is horizontal. Therefore, it is easy to wire the electric wire. Further, since the electric wire is not exposed, an outer appearance will be preferable.

The present invention is not limited to the embodiments mentioned above.

For example, the shape, the position and the magnitude of the downwardly extending portion extending downward from the lower surface of the image reading unit can be appropriately modified, as far as the downwardly extending portion is formed as a portion formed in the lower surface of the image reading unit and contacts with the side surface of the column support portion.

In the present embodiment for example, the downwardly extending portions 204 and 205 extending downward from the lower surface of the image reading unit 200 can be appropriately structured in any shape, position and magnitude, as far as the downwardly extending portion is formed in the lower surface of the image reading unit 200 and contacts with the side surfaces 300B and 302B of the first column support portion 300 and the second column support portion 302.

Further, for example, the image forming unit in the invention is not limited to the structure of the image forming unit 100 in accordance with the embodiment mentioned above. It may be constituted by an image forming unit having the other structure utilizing a known electrophotographic system. Alternatively, it may be constituted by an image forming unit utilizing an image forming system other than the electrophotographic system, for example, a known ink jet recording system performing an image formation by an ink jet recording head which discharges an ink drop from a nozzle.

Further, the second column support 600 may have the same structure as the first column support 500.

What is claimed is:

1. An image forming apparatus comprising:

an image reading unit;

an image forming unit; and first and second column support portions supporting the image reading unit, wherein the image reading unit comprises downwardly extending portions extending downward from a lower surface thereof, both of the first and second column support portions support the image reading unit in a cantilever manner so that a space is provided between the image reading unit and an upper surface of the image forming unit, and the first and second column support portions receive the lower surface of the image reading unit at respective upper surfaces thereof, and receive the downwardly extending portions of the image reading unit at respective side surfaces thereof.

2. The image forming apparatus of claim 1, wherein the image reading unit is coupled to the first and second column support portions by a hinge and is structured so as to be upwardly rotatable from an approximately horizontal state around the hinge, and the side surface of the first and second column support portions receives the downwardly extending portion of the image reading unit at a position at which the image reading unit is in a substantially horizontal state.

3. The image forming apparatus of claim 1, wherein the image reading unit comprises a convex portion at a lower surface thereof, and the first and second column support portions comprise an insertion portion into which the convex portion of the image reading unit is inserted.

4. The image forming apparatus of claim 3, further comprising a hinge coupling the image reading unit and the convex portion, wherein the image reading unit is coupled to the first and second column support portion via the hinge and the convex portion, and is structured so as to be upwardly rotatable from an approximately horizontal state around the hinge.

5. The image forming apparatus of claim 3, wherein the image forming unit comprises a casing, and each of the first and second column support portions comprise:

a first support portion fixed to a side surface of the casing of the image forming unit, supporting the image reading unit and provided with the insertion portion; and a second support portion extending in a horizontal direction parallel to the image reading unit which is arranged in the cantilever manner from the first support portion, wherein a receiving portion fixing the second support portion is provided at the side surface of the casing.

6. The image forming apparatus of claim 5, wherein the receiving portion is formed as a frame body fixed to the side surface of the casing and rising up from the side surface, and the second support portion is fixed to the frame body.

7. The image forming apparatus of claim 1, further comprising an electric wire electrically connecting the image reading unit and the image forming unit, wherein the electric wire is wired in an inner portion of one of the first and second column support portions.

8. The image forming apparatus of claim 1, wherein the downwardly extending portion is formed in an approximately inverted triangular shape in which a lower surface of the image reading unit forms a base edge of the triangle, in a side view.

9. An image forming apparatus comprising:

an image reading unit;

an image forming unit; and a plurality of column support portions supporting the image reading unit, wherein the image reading unit comprises a plurality of downwardly extending portions at positions corresponding to the column support portions, at a lower surface thereof, the column support portions supports the image reading unit in a cantilever manner so that a space is provided between the image reading unit and an upper surface of the image forming unit, and the column support portions receive the lower surface of the image reading unit at respective upper surfaces thereof, and receive the downwardly extending portions of the image reading unit at respective side surfaces thereof.

10. The image forming apparatus of claim 9, wherein the image reading unit is coupled to the column support portions by hinges and is structured so as to be upwardly rotatable from an approximately horizontal state around the hinges, and the side surfaces of the column support portions receive the downwardly extending portions of the image reading unit at a position at which the image reading unit is in a substantially horizontal state.

11. The image forming apparatus of claim 9, wherein the image reading unit comprises a plurality of convex portions at positions corresponding to the column support portions, at a lower surface thereof, and each of the column support portions comprises an insertion portion into which one of the convex portions of the image reading unit is inserted.

12. The image forming apparatus of claim 11, further comprising hinges coupling the image reading unit and the convex portions, wherein the image reading unit is coupled to the column support portions via the hinges and the convex portions, and is structured so as to be upwardly rotatable from an approximately horizontal state around the hinges.

13. The image forming apparatus of claim 11, wherein the image forming unit comprises a casing, and at least one of the plurality of column support portions comprises:

a first support portion fixed to one side surface of the casings of the image forming unit, supporting the image reading unit and provided with the insertion portion; and a second support portion extending in a horizontal direction parallel to the image reading unit which is arranged in the cantilever manner from the first support portion, wherein a receiving portion fixing the second support portion is provided at the side surface of the casing.

14. The image forming apparatus of claim 13, wherein the receiving portion is formed as a frame body fixed to the side surface of the casing and rising up from the side surface, and the second support portion is fixed to the frame body.

15. The image forming apparatus of claim 9, further comprising an electric wire electrically connecting the image reading unit and the image forming unit, wherein the electric wire is wired in an inner portion of at least one of the colunm support portions.

16. The image forming apparatus of claim 9, wherein the column support portions comprises first and second column support portions, and are respectively rise up at back surface side corner portions of the image forming unit.

17. The image forming apparatus of claim 9, wherein each of the downwardly extending portions is formed in an approximately inverted triangular shape in which a lower surface of the image reading unit forms a base edge of the triangle, in a side view.

* * * * *